United States Patent [19]

Brichoud et al.

[11] Patent Number: 4,747,613

[45] Date of Patent: May 31, 1988

[54] SKI MANUFACTURED TO HAVE PRE-BORED SCREW HOLES FOR THE MOUNTING OF BINDINGS

[75] Inventors: Jean-Claude Brichoud, Seynod; Pierre Rullier, Annecy, both of France

[73] Assignee: Salomon S.A., Annecy, France

[21] Appl. No.: 7,633

[22] Filed: Jan. 28, 1987

[30] Foreign Application Priority Data

Mar. 14, 1986 [FR] France ..... 86 04127

[51] Int. Cl.[4] ..... A63C 9/00

[52] U.S. Cl. ..... 280/611

[58] Field of Search ..... 280/607, 609, 610, 611, 280/618, 633, 634, 636; 411/13, 14

[56] References Cited

U.S. PATENT DOCUMENTS

| | | | |
|---|---|---|---|
| 3,295,859 | 1/1967 | Perrg | 280/609 |
| 3,917,299 | 11/1975 | Anderson | 280/11.13 W |
| 3,926,451 | 12/1975 | Guild | 280/609 |
| 3,977,688 | 8/1976 | Imagawa | 280/633 |

FOREIGN PATENT DOCUMENTS

| | | |
|---|---|---|
| 0028165 | 10/1967 | Austria . |
| 2497459 | 7/1982 | France . |

*Primary Examiner*—John J. Love
*Assistant Examiner*—Richard Lamby
*Attorney, Agent, or Firm*—Sandler & Greenblum

[57] ABSTRACT

A ski manufactured to have screw holes for receiving binding mounting screws in the intermediate mounting zone of the ski. The screw holes correspond in number and position to the arrangement of mounting screws of at least one binding apparatus for binding a shoe or boot to the ski. The screw holes can be made by molding or machining the exterior envelope and inner core layer of the ski and can be capped or filled with plugs. The screw holes are preferably covered with a protection sheet provided with corresponding references designating the location of the covered screw holes. Manufacturing skis to have pre-bored screw holes eliminates the need for templates and boring tools otherwise required when mounting bindings to skis which is normally performed in ski shops by the retailer.

33 Claims, 2 Drawing Sheets

FIG. 3.
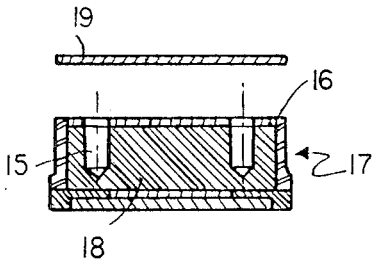
FIG. 4.
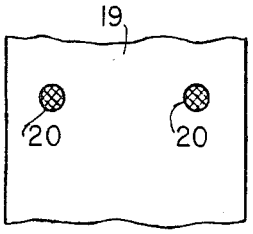
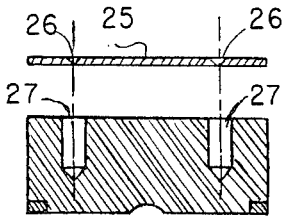
FIG. 5.
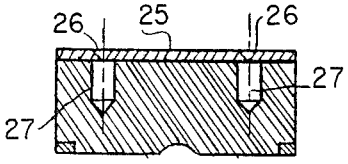
FIG. 6.
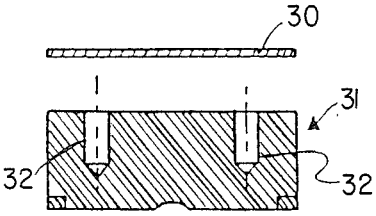
FIG. 7.
FIG. 8.
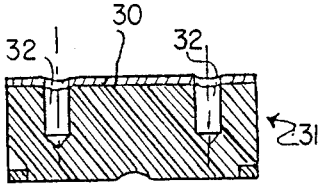
FIG. 9.
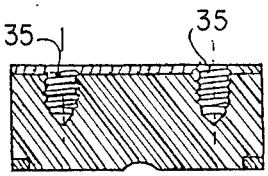
FIG. 10.
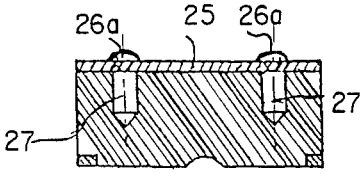
FIG. 11.
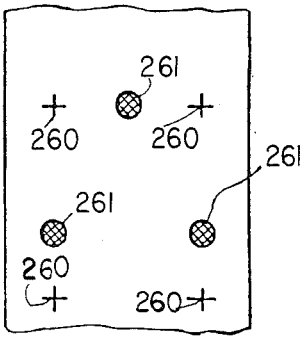

SKI MANUFACTURED TO HAVE PRE-BORED SCREW HOLES FOR THE MOUNTING OF BINDINGS

BACKGROUND OF THE INVENTION

1. Field of the Invention

The present invention relates to skis in general, including but not limited to cross-country skis, alpine skis, and mountaineering skis. In particular, the present invention is directed to manufacturing skis to have means for receiving screws used when mounting shoe retention bindings on skis. Specifically, the present invention is directed to providing a section of the ski to which bindings are normally mounted with a plurality of bores arranged to correspond to particular arrangements of screw holes of binding hardware during the manufacture of the ski.

2. Description of Background and Relevant Materials

Modern skis include a predefined mounting zone situated in an intermediate portion of the ski known as the waist, i.e., the area on which the boot is normally positioned, which is located between the shovel or blade and the heel or tail of the ski. The mounting zone is normally reinforced to a certain degree to allow for using screws to mount the bindings to the skis. In order to facilitate the mounting of binding, it is common to provide mounting reference points for installing the bindings which makes it possible to place the shoe or boot in the proper position on this zone.

The mounting of bindings is performed most often in retail ski shops after the skis have been shipped from the factory. In conventional procedures for mounting the bindings, boring templates as well as boring apparatus, such as drills, screw drivers, pliers and other hand tools are required to guarantee the purchasers of the skis and bindings a correct installation of the bindings on the skis and the use of proper materials. This procedure for mounting bindings to skis, however, is a delicate operation to execute by virtue of the various parameters, such as the length of the shoes or boots, the position of the template, the diameter of the screws and the thickness of the skis, which must be taken into account. The procedure is often annoying and, in any event, is normally time consuming. More importantly, however, proper mounting of bindings to skis require the expertise of qualified ski mechanics. Regardless of the experience of the mechanic, however, there is always the possible risk of error on the part of the installer which could result in damage to or destruction of the ski.

SUMMARY OF THE INVENTION

It is an objective of the invention to overcome these disadvantages in a simple and effective manner eliminating the need for the use of specific or substantial apparatus for the mounting of bindings to skis.

An object of the present invention is to provide a ski manufactured to have a binding mounting zone including a number of bores corresponding at least in number and position to a mounting screw arrangement of a binding apparatus for binding a shoe or boot to the ski. Preferably, the bores correspond in number and in position to the mounting screw arrangement of a plurality of different binding apparatus.

Another object of the present invention is to provide a ski manufactured to have a number of bores corresponding in number and position to a mounting screw arrangement of a binding apparatus which also includes a protection element and/or a reinforcement plate positioned above the binding mounting zone. The reinforcement plate is provided with orifices corresponding in number and position to the bores in the core layer of the mounting zone of the ski. The protection element may be laminated directly over the core layer of the ski or over the reinforcement plate depending on the particular construction of the ski. In either instance, the protection element covers the tops of the bores. Preferably, the protection element is at least a portion of the upper cosmetic surface of the ski, and may be made from materials selected from the group of translucent materials, transparent materials and opaque materials, the latter preferably being provided with references to designate the location of the underlying bores. The references may be graphic symbols, such as characters, e.g., numerals and letters, as well as symbols and designs, which may also be color-coded to designate the location of a particular arrangement of bores.

Another further object of the present invention is to provide a ski manufactured to have a number of bores corresponding in number and position to a mounting screw arrangement of a binding apparatus covered by a protection sheet provided with physical references to designate the location of the bores. In one embodiment, the physical references may be protuberances, which are attached to the protection sheet or raised portions of the protection sheet. In another embodiment, the references may be hollowed-out or indented, concave areas of the protection sheet.

It is another object of the present invention to provide a method of manufacturing skis adapted to receive a binding apparatus which involves the steps of providing a ski having a front end, a tail end and including a base surface, with a contiguous core layer having an intermediate zone adapted for mounting ski bindings; and forming a number of bores having an arrangement corresponding in at least number and position to a mounting screw arrangement of a binding apparatus in the intermediate zone of the core layer, preferably wherein the bores are formed by machining or molding the intermediate zone of the core layer to have holes adapted to receive binding mounting screws.

It is yet another object of the present invention to provide a method for manufacturing skis to have pre-bored screw receptacles, as described above, which also involves filling the bores with removeable plugs, pins or screws which may be used to mount the binding apparatus to the ski.

It is yet still another object of the present invention to provide a method for manufacturing skis having pre-bored screw receptacles, as described above, which also involves covering the intermediate zone with a protection element having an upper surface, and modifying the upper surface of the protection element to have references designating the location of the underlying bores, wherein the references are convex raised areas or concave impressions in the upper surface of the protection element.

It is a further object of the present invention to provide a method for manufacturing skis having pre-bored screw receptacles, as described above, wherein the impressions on the surface of the protection element covering the screw receptacles are provided by heat shrinking the protection element to result in hollowed-out, concave areas above the bores, or by stamping the upper surface of the protection element to result in indented concave areas.

It is a yet still further object of the present invention is to provide a method for manufacturing skis having pre-bored screw receptacles, as described above, wherein the references designating the location of the screw receptacles are printed as graphic characters and symbols, such as numerals, letters, logos and trademarks, which may also be color-coded, on the upper surface of the protection element.

BRIEF DESCRIPTION OF THE DRAWINGS

The invention will be better understood with reference to the description which follows making reference to the annexed drawings given by way of non-limiting example only of several ski embodiments in which:

FIG. 3 is a cross-sectional view of an embodiment of a ski provided with pre-bored screw holes showing the screw holes extending through a reinforcement plate covering the core layer of the ski;

FIG. 4 is a plane view of the upper surface of a ski of the present invention showing a protection sheet provided with reference points for designating the location of underlying screw holes;

FIGS. 5 and 6 are cross-sectional views of an embodiment of a ski in accordance with the present invention wherein the protection sheet is provided with hollowed-out areas as references designating the location of underlying screw holes;

FIGS. 7 and 8 are cross-sectional views of an embodiment of a ski of the present invention wherein concave reference points are provided by gluing a thin protection sheet over the core of the ski having pre-bored screw holes;

FIG. 9 is a cross-sectional view of an embodiment of a ski of the present invention wherein the screw holes are provided with threads;

FIG. 10 is a cross-sectional view of an embodiment of a ski in accordance with the present invention wherein the protection sheet is provided with raised areas as references designating the location of underlying screw holes; and FIG. 11 is a plane view of the upper surface of an embodiment of a ski schematically illustrating reference points for designating the location of underlying screw holes as numerals and geometric shapes.

DESCRIPTION OF PREFERRED EMBODIMENTS

Figure 1:
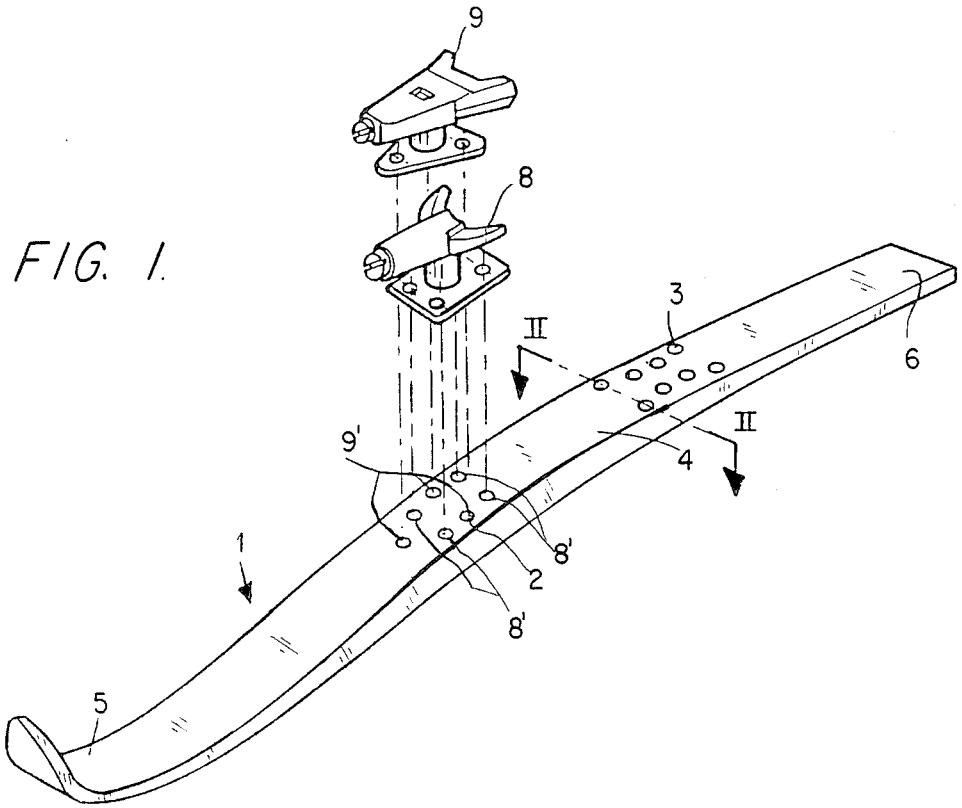
FIG. 1 schematically illustrates a ski according to the invention provided during its manufacture with a series of mounting holes, corresponding to two types of bindings.

According to the present invention, skis are pre-bored during their manufacture to have screw holes adapted to receive the screws of binding apparatus. These holes or screw receptacles are positioned such that their arrangement corresponds to standard or specific mounting screw arrangements of one or more binding models. The screw receptacles are preferably covered by a protection element, sheet or mask so that the pre-bored screw holes do not adversely affect the aesthetic features of the cosmetic surface of the ski and to protect the core of the ski against the effects of the elements, such as snow, dirt or dampness.

Preferably, reference points are provided on the upper exterior cosmetic layer of the ski or are applied in a manner so as to make it possible to readily locate the covered screw holes. To this end, one can provide reference points which are tactile, i.e., hollowed out as an indentation, or in raised relief as a protuberance. Alternatively, the reference points may be graphic symbols, such as numerical or alphabetic characters, designs and logos, which may be color-coded, or in the nature of distinctive drawings of the general decor of the bottom of the ski. In the instance where transparent masks and protection sheets are used as overlays to cover the screw receptacles or mounting holes, reference points on the cover are not as necessary to locate the position of the screw holes which can be seen through the transparent overlay.

The manufacture of all types of skis and similar devices requiring the subsequent mounting of binding apparatus or other devices may be modified in accordance with the present invention so as to provide the ski with pre-bored screw receptacles. In particular, the present invention is suitable for modifying downhill as well as cross country and mountaineering skis, in addition to monoskis or boards, designed to be used on snow. In addition, counterparts of such skis equipped with rollers or wheels for use in the absence of snow, for example as training and exercise devices used on dry land, may also be manufactured in accordance with the present invention.

The production of skis in accordance with the present invention is otherwise the same as conventional methods for making skis which do not pre-bore the core of the intermediate mounting zone of the ski with screw receptacles during the manufacturing process. In the present invention, however, the core of the ski, which is located above the base layer having the running surface, is either molded or machined, for example by drilling or tapping, during the manufacturing process to have hollow areas, corresponding in number and location to the arrangement of screws of binding apparatus to be mounted to the ski. The core of the ski is pre-bored in accordance with the present invention preferably before the uppermost surfaces, such as protection sheet and cosmetic or decor layers, are applied over the core. It has also been found to be particularly beneficial to reinforce the intermediate mounting zone of the ski which is provided with pre-bored screw receptacles during the manufacture of the ski in accordance with the present invention with a reinforcement plate. To this end, a reinforcement plate is provided with orifices which correspond in number and position to the arrangement of screw receptacles formed in the core layer of the ski so that the orifices of the plate and the openings at the top of the screw receptacles align when the reinforcement plate is properly positioned above the core layer of the intermediate mounting zone of the ski. In this case, the protective sheet may then be applied over the reinforcement plate to complete the manufacture of the ski in accordance with the present invention as described herein.

Figure 2:
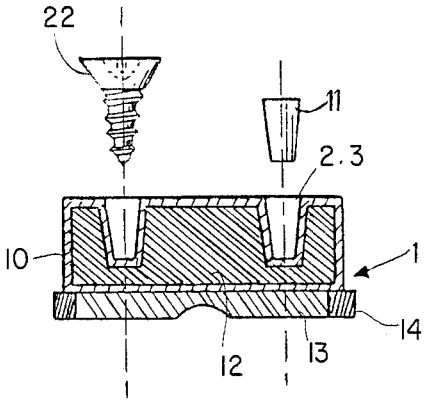
FIG. 2 is a cross-sectional view along II—II of FIG. 1 showing in detail the screw hole configuration.

As may be seen in FIGS. 1 and 2, ski 1 is formed with a series of screws, holes or receptacles 2 and 3 provided in the intermediate mounting zone or waist 4 of the ski, between the spoon or shovel 5 and heel or tail 6 of the ski. In the illustrated example, the screw receptacles 2 and 3 are adapted to receive mounting screws 22 so as to allow for the positioning of two different types of bindings 8 and 9. The screw holes may be formed during the molding of the core layer 12 of ski 1. In other respects, however, the construction of the ski is conventional. As shown, the core 12 is laminated to the base 13 which is normally composed of a plastic material, such as P-tex, having edges 14 which are typically metal.

Depending upon the binding selected, one utilizes corresponding screw receptacles or holes which are, in the case shown, the three holes 9' for the binding apparatus 9 and the four holes 8' for the other binding apparatus 8. The screw receptacles or mounting holes of the heel element, not shown, are provided in the same manner as the binding apparatus 8 and 9. The holes 8' and 9' which are not utilized during the positioning of binding apparatus 8 or 9 are preferably filled by plugs or pins 11, as shown in FIG. 2. The screw receptacles may be formed during the manufacture of the ski by machining or molding the core layer in the intermediate mounting zone at appropriate predetermined locations.

Although the screw receptacles can be formed as bores with smooth side walls, as illustrated in FIGS. 2, 3, 5, 6, 7 and 8, the present invention also provides for forming tapped bores 35 having threaded side walls adapted to receive threaded screws to be used when mounting the binding to the ski, as shown in FIG. 9. For purposes of the embodiment illustrated in FIG. 9, threaded plugs or pins (not shown) can be used to fill the screw receptacles. To this end, screws 22 intended to be used to mount the binding to the ski can also be used to fill the screw receptacles during the manufacture of the ski. This embodiment is particularly advantageous in eliminating the step of modifying smooth walled bores by drilling or tapping so as to accommodate threaded screws during installation of the binding in the ski shop. The present invention, therefore provides means and methods for simplifying the installation of bindings on skis in a manner which is quicker and easier than prior operations and minimizes the possibilities for making mistakes which could be damaging or destructive to the ski.

In the example illustrated in FIG. 3, the mounting zone of the ski is shown as being reinforced by a plate 16 applied over the core layer. Reinforcement of the mounting zone is preferable particularly where the core layer has been provided with a number of screw holes not filled with pins or plugs which could weaken the structure of the ski. The plate may be made of any material, such as metal or plastic, which is suitable to provide additional strength to this area of the ski. As shown, screw receptacles 15 extend through a reinforcement plate 16 of the upper structure 17 of the ski. To assure the protection of core 18 of the ski, the top of the ski is then covered with a protection element or sheet 19 made of a material capable of sealing the inner structure or core layer against dirt and moisture which could be damaging to the ski. The protection element 19 in the area over the mounting zone may be translucent or transparent so that the screw receptacles can be seen through the sheet.

As shown in FIG. 4, the sheet 19 may be provided with reference points 20 to indicate the position of screw receptacles 15, particularly when the protection sheet is opaque. This protection sheet 19 preferably constitutes the cosmetic layer applied as the top surface of the ski.

FIGS. 5–9 and 10 illustrate some examples of providing the protection sheet with reference points to designate the location of the screw receptacles. As shown in FIGS. 5 and 6, the protection sheet 25 is provided with reference points 26 which correspond to the position of screw receptacles 27. One can, of course, provide these points after the positioning of the protective sheet over the core. To this end, as illustrated in FIGS. 7 and 8, a relatively thin protection sheet 30 may be glued on the top of the ski 31 in a manner such that this sheet deforms by suction in the area covering the top of screw receptacles 32 to form an indentation or concave area which can be felt as well as being seen. One can also obtain such a deformation or indentation of the protection sheet 30 by subjecting the protective sheet to a heat source which causes a slight deepening of the sheet by dilation of the sheet at the location of holes 32. In this embodiment, the protection sheet is preferably made from a heat shrinkable plastic material suitable for this purpose.

Alternatively, the protection sheet can be provided with hollowed-out areas as references to designate the location of the screw receptacles by physically marking the surface of the protection sheet to have indentations. This can be accomplished by ticking or scoring the surface of the protection sheet with a pointed instrument, but is preferably carried out using a press during the manufacture of the ski, for example by stamping the surface of the protection layer with a plate having an arrangement of tools corresponding in number and position to the bores which have been molded or machined into the inner core layer of the ski.

In contrast to forming concave reference points in the protection sheet in some fashion consistent with the previous discussion, the protection sheet 25 may be provided with protuberances or raised areas to designate the location of the screw receptacles 27, shown as elements **26*a* in FIG. 10**. To this end, the protuberances may be applied, for example by using suitable adhesives, to the upper surface of the protective sheet. Preferably, however, the protective sheet is molded or otherwise modified to have raised areas in appropriate positions corresponding to the number and location of the screw receptacles. This is a particularly suitable expedient for designating the location of tapped screw receptacles which are filled with mounting screws since the hollowed-out raised areas of the protection sheet effectively form caps to accommodate a portion of the screw heads which may extend to some degree above the core layer. Alternatively, the protection sheet may be heat shrunk, as previously described, over the screw heads and core layer to result with raised areas over the location of the screw receptacles.

Another manner by which the location of the underlying screw receptacles can be designated is by printing graphic symbols on the upper surface of the protection sheet. This is accomplished by using essentially the same technique normally used to apply cosmetic designs, brand and model identifications to the upper surface of the ski. In this instance, however, one or more arrangements of characters, numerical and/or alphabetic, corresponding to the number and position of the underlying screw receptacles are printed on the upper cosmetic layer or protection sheet located above the mounting zone. In addition to numerals or letters, the designations may be color-coded shapes, such as circles, triangles, rectangles or squares, as well as symbols, such as company logos or brand identifications. Thus, one can indicate the location of screw holes corresponding to a size, model, and/or make of binding, as indicated in FIG. 11, for example using cross reference numerals 260, while at the same time indicating the screw holes of another model and/or make, for example using circles 261, which may or may not also be color-coded.

In accordance with the present invention, therefore, any of the previously described procedures can be used to provide the skis with a relatively substantial number of mounting holes or screw receptacles corresponding to different models of bindings, bindings manufactured by different companies, as well as different arrangements of screw receptacles for mounting bindings to accommodate the full range of boot sizes. Notwithstanding such differences, however, the means and methods of the present invention permit the core of the mounting zone of the ski to be modified during the manufacture of the ski in the factory to provide any or all of the possible mounting screw requirements so as to simplify the mounting of bindings onto the skis by the retailer or purchaser of the skis.

From the foregoing description, one skilled in the art can easily ascertain the essential characteristics of this invention and, without departing from the spirit and scope thereof, make various changes and modifications of the invention to adapt to various usages and conditions.

We claim:

1. A ski manufactured to have a binding mounting zone comprising a number of bores corresponding at least in number and in position to a mounting screw arrangement of a binding apparatus for binding a shoe or boot to a ski and a protection element composed of a material selected from the group of translucent material, transparent material, and opaque material, covering said bores.

2. The ski according to claim 1 wherein said bores correspond in number and in position to the mounting screw arrangement of a plurality of different binding apparatus.

3. The ski according to claim 1 wherein said bores have a dimension corresponding to a dimension of the mounting screws of the binding apparatus.

4. The ski according to claim 1 comprising a reinforcement plate covering said binding mounting zone.

5. The ski according to claim 1 wherein said protection element comprises at least a portion of the upper cosmetic surface of the ski.

6. The ski according to claims 1 wherein said protection element is provided with graphic references to designate the location of said bores.

7. The ski according to claim 6 wherein said graphic references include characters.

8. The ski according to claim 7 wherein said characters include numerals.

9. The ski according to claim 7, wherein said characters include letters.

10. The ski according to claim 6, wherein said graphic references include symbols.

11. The ski according to claim 6, wherein said graphic references are color-coded to designate the location of a particular arrangement of bores.

12. The ski according to claim 1 wherein said protection element is provided with convex references to designate the location of said bores.

13. The ski according to claim 12, wherein said convex areas are integral raised areas of said protection element.

14. The ski according to claim 12, wherein said convex areas are protuberances attached to said protection element.

15. The ski according to claim 1 wherein said protection element is provided with concave references to designate the location of said bores.

16. The ski according to claim 15, wherein said protection element is provided with graphic references.

17. The ski according to claim 16, wherein said graphic references are members selected from the group consisting of symbols, designs, numbers, letters and combinations thereof.

18. The ski according to claim 17, wherein said graphic references are color-coded.

19. A method of manufacturing skis adapted to receive a binding apparatus comprising the steps of:

(a) providing a ski having a front end, a tail end and including
  (i) a base surface, and
  (ii) a contiguous core layer having an intermediate zone adapted for mounting ski bindings;
(b) forming a number of bores having an arrangement corresponding in at least number and position to a mounting screw arrangement of a binding apparatus in said intermediate zone of said core layer;
(c) covering said bores in said intermediate zone with a protection element having an upper surface; and
(d) modifying said upper surface of the protection element to have references designating the location of said bores.

20. The method of manufacturing skis in accordance with claim 19, wherein said forming is accomplished by machining said bores into said intermediate zone of said core layer.

21. The method of manufacturing skis in accordance with claim 19, wherein said forming is accomplished by molding said core layer to have bores in said intermediate zone.

22. The method of manufacturing skis in accordance with claim 19, further comprising filling said bores with removal plugs prior to said covering said bores with a protection element.

23. The method of manufacturing skis in accordance with claim 14, comprising:

(d) covering said intermediate zone with a reinforcement plate.

24. The method of manufacturing skis in accordance with claim 23, wherein said reinforcement plate is provided with orifices corresponding in number and in position to said bores formed in said intermediate zone.

25. The method of manufacturing skis in accordance with claim 19, wherein said modifying is accomplished by providing said upper surface with raised areas as said references.

26. The method of manufacturing skis in accordance with claim 25, wherein said modifying is accomplished by providing said upper surface with impressions as said references.

27. The method of manufacturing skis in accordance with claim 26, wherein said impressions are obtained by gluing said protection element over said intermediate mounting zone such that said protection element deforms to form concave areas in the opening of the bores.

28. The method of manufacturing skis in accordance with claim 26, wherein said impressions are obtained by heat shrinking said protection element to result in hollowed out areas above said bores.

29. The method of manufacturing skis in accordance with claim 26, wherein said impressions are obtained by stamping said upper surface so as to result in indented areas in said protection element.

30. The method of manufacturing skis in accordance with claim 19, wherein said modifying is accomplished by printing graphic symbols as said references on said upper surface.

31. The method of manufacturing skis in accordance with claim 30, wherein said graphic symbols include numerical characters.

32. The method of manufacturing skis in accordance with claim 30, wherein said graphic symbols include alphabetic characters.

33. The method of manufacturing skis in accordance with claim 30, wherein said graphic symbols include trademarks.

* * * * *